US011114018B2

(12) United States Patent
Jo et al.

(10) Patent No.: US 11,114,018 B2
(45) Date of Patent: Sep. 7, 2021

(54) LIGHT EMITTING DISPLAY DEVICE AND METHOD FOR DRIVING SAME

(71) Applicant: LG Display Co., Ltd., Seoul (KR)

(72) Inventors: Jung-Geun Jo, Gimpo-si (KR); Tae-Uk Kim, Seoul (KR); Yu-Hoon Kim, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/894,275

(22) Filed: Jun. 5, 2020

(65) Prior Publication Data

US 2020/0388207 A1 Dec. 10, 2020

(30) Foreign Application Priority Data

Jun. 5, 2019 (KR) ..... 10-2019-0066450

(51) Int. Cl.
*G09G 3/20* (2006.01)
*G09G 3/22* (2006.01)

(52) U.S. Cl.
CPC ..... *G09G 3/2074* (2013.01); *G09G 3/2003* (2013.01); *G09G 3/22* (2013.01); *G09G 2320/0233* (2013.01); *G09G 2320/0242* (2013.01); *G09G 2320/0257* (2013.01); *G09G 2320/045* (2013.01); *G09G 2320/0606* (2013.01); *G09G 2320/0626* (2013.01); *G09G 2320/0673* (2013.01); *G09G 2320/08* (2013.01); *G09G 2360/141* (2013.01); *G09G 2360/144* (2013.01)

(58) Field of Classification Search
CPC ..... G09G 3/2074; G09G 3/2003; G09G 3/22; G09G 2320/0233; G09G 2320/0242; G09G 2320/0257; G09G 2320/045; G09G 2320/0606; G09G 2320/0626; G09G 2320/0673; G09G 2320/08; G09G 2360/141; G09G 2360/144
See application file for complete search history.

(56) References Cited

U.S. PATENT DOCUMENTS

| | | | | |
|---|---|---|---|---|
| 2002/0005913 | A1 | 1/2002 | Morgan et al. | |
| 2016/0247460 | A1 * | 8/2016 | Kim | G09G 3/3413 |
| 2017/0092189 | A1 | 3/2017 | Hwang | |
| 2017/0098407 | A1 | 4/2017 | Jeong et al. | |

FOREIGN PATENT DOCUMENTS

| | | | |
|---|---|---|---|
| CN | 106097964 | A | 11/2016 |
| JP | 2005-148306 | A | 6/2005 |
| JP | 2013-127523 | A | 6/2013 |
| KR | 10-2006-0122307 | A | 11/2006 |

* cited by examiner

*Primary Examiner* — Peter D McLoone
(74) *Attorney, Agent, or Firm* — Seed IP Law Group LLP

(57) ABSTRACT

The present disclosure relates to a display device and a method for driving the same which can improve color unevenness in a low-grayscale (low-luminance) area and improve color accuracy and grayscale expression, and an image processor of a display device according to an embodiment identifies a low-grayscale area less than a threshold value according to an input maximum luminance and applies a grayscale reproduction mask thereto to reproduce a luminance of the low-grayscale area as a combination of the threshold value and a minimum value.

20 Claims, 10 Drawing Sheets

LIGHT EMITTING DISPLAY DEVICE AND METHOD FOR DRIVING SAME

BACKGROUND

Technical Field

The present disclosure relates to a light emitting display device and a method for driving the same.

Description of the Related Art

A liquid crystal display (LCD) using liquid crystal and light emitting display devices using spontaneous light emitting elements such as organic light emitting diodes (OLEDs) are mainly used as display devices.

Light emitting display devices have the advantages of a high luminance, a low driving voltage, and implementation as an ultra-thin free shape because they use spontaneous light emitting elements having emission layers which emit light according to recombination of electrons and holes.

Each subpixel constituting a light emitting display device includes a light emitting element and a pixel circuit for driving the light emitting element, and the pixel circuit includes a plurality of thin film transistors (TFTs) and a storage capacitor. A driving TFT of the pixel circuit controls the amount of emission of the light emitting element by receiving a driving voltage Vgs corresponding to a data signal through the storage capacitor and adjusting current Ids for driving the light emitting element.

Light emitting display devices may have decreased low grayscale expression because they cannot represent discriminable grayscale (luminance) steps using low current during representation of low grayscales. Since light emitting display devices have specific points and gamma forms at which low grayscale expression decreases and which are different for colors, color unevenness due to luminance deviation and artifacts such as color distortion may occur in a low-grayscale area. In light emitting display devices, image sticking may be caused by luminance deviation due to lifespan deviations between light emitting elements according to usage thereof.

BRIEF SUMMARY

One or more embodiments of the present disclosure provides a light emitting display device and a method for driving the same which can improve color unevenness in a low-grayscale (low-luminance) area and enhance color accuracy and grayscale expression.

One or more embodiments of the present disclosure is provides a light emitting display device and a method for driving the same which can improve image sticking by reducing lifespan deviations between light emitting elements.

A display device according to an embodiment includes: an image processor for converting image data that is less than a threshold value into any one of either the threshold value and a minimum value using a grayscale reproduction mask that is based on the threshold value, outputting the converted image data, and outputting image data equal to or greater than the threshold value without changing the image data; a panel operatively coupled to the image processor, the panel including a plurality of subpixels having light emitting elements; and a panel driver operatively coupled to the image processor and the panel, the panel driver providing the output of the image processor to the panel. The threshold value may be selected based on an input maximum luminance value.

In a low-grayscale area less than the threshold value, positions of subpixels representing the threshold value and positions of subpixels representing the minimum value may be varied with a lapse of driving time of the panel. Positions of subpixels representing the threshold value and positions of subpixels representing the minimum value may be varied according to a cumulative usage of each light emitting element and the threshold value.

The image processor according to an embodiment includes: a threshold value look-up table (LUT) for selecting a threshold value of each color corresponding to the input maximum luminance from a plurality of different threshold values set for colors and outputting selected threshold values for a plurality of maximum luminances; an element usage accumulator for accumulating output of a previous frame as a usage of each light emitting element; a mask generator for generating and outputting the grayscale reproduction mask of each color in consideration of the threshold value of each color output from the threshold value LUT and a cumulative usage of each light emitting element stored in the element usage accumulator; and a grayscale reproduction processor for comparing input image data with the threshold value of each color, comparing image data less than the threshold value of each color with each mask value determined in the grayscale reproduction mask of each color, converting the image data into the threshold value of each color or the minimum value, outputting the converted image data, and outputting image data equal to or greater than the threshold value of each color without converting the image data.

A method for driving a light emitting display device according to an embodiment includes: selecting a threshold value of each color based on an input maximum luminance from a plurality of different threshold values set for colors, outputting selected threshold values for a plurality of maximum luminances, accumulating output of a previous frame as a usage of each light emitting element for each of a plurality of subpixels, generating a grayscale reproduction mask of each color in consideration of the selected threshold value of each color and a cumulative usage of each light emitting element, comparing input image data with the threshold value of each color, comparing image data less than the threshold value of each color with a corresponding mask value in the grayscale reproduction mask of each color, converting the image data into the threshold value of each color or a minimum value, outputting the converted image data, outputting image data equal to or greater than the threshold value of each color without converting the image data, and displaying an output of the grayscale reproduction step on a panel.

The mask generator may determine each mask value corresponding to each subpixel and generate the grayscale reproduction mask of each color in consideration of sequence values assigned to subpixels corresponding to the grayscale reproduction mask of each color in response to the cumulative usage of each light emitting element, a gamma constant, the threshold value of each color, and the size of the grayscale reproduction mask.

The grayscale reproduction processor may convert image data less than the threshold value of each color into the threshold value of each color and output the converted image data if the image data is greater than a corresponding mask value of the grayscale reproduction mask of each color, and convert image data less than the threshold value of each color into the minimum value and output the converted image data if the image data is equal to or less than a corresponding mask value of the grayscale reproduction mask of each color.

The image processor may further include a luminance converter for converting the output of the previous frame into a luminance value and outputting the luminance value to the element usage accumulator when the threshold value of each color is a grayscale value.

The image processor may further include: a luminance converter positioned at an input terminal of the grayscale reproduction processor to convert a grayscale value which is the input image data into a luminance value and output the luminance value to the grayscale reproduction processor when the threshold value of each color is a luminance value; and a grayscale converter for converting a luminance value output from the grayscale reproduction processor into a grayscale value and outputting the grayscale value, wherein the element usage accumulator receives and accumulates the output of the grayscale reproduction processor as output of the previous frame.

The light emitting display device can reproduce a luminance of a low-grayscale area less than the threshold value of each color according to the threshold value of each color and the minimum value by applying the grayscale reproduction mask of each color to the low-grayscale area.

According to at least one embodiment, it is possible to reduce luminance deviation in a low-grayscale area to improve color unevenness and enhance color accuracy and low-grayscale expression by generating and applying a grayscale reproduction mask considering a maximum luminance of a light emitting display device and the lifespan of each light emitting element to reproduce a low grayscale as a combination of a threshold value for achieving excellent uniformity and grayscale expression and a minimum value 0.

According to at least one embodiment, it is possible to improve color unevenness in a low-grayscale area and enhance color accuracy and low-grayscale expression irrespective of luminance change by generating and applying a grayscale reproduction mask using a threshold value of each color which varies according to change of a maximum luminance of a display device.

According to at least one embodiment, it is possible to reduce lifespan deviations between light emitting elements by varying each mask value of a grayscale reproduction mask on the basis of the usage of each light emitting element to vary positions of subpixels corresponding to threshold values and positions of subpixels corresponding to a minimum value and to improve image sticking by decreasing luminance deviation due to lifespan deviations between light emitting elements.

DETAILED DESCRIPTION

Hereinafter, preferred embodiments of the present disclosure will be described with reference to the drawings.

Figure 1:
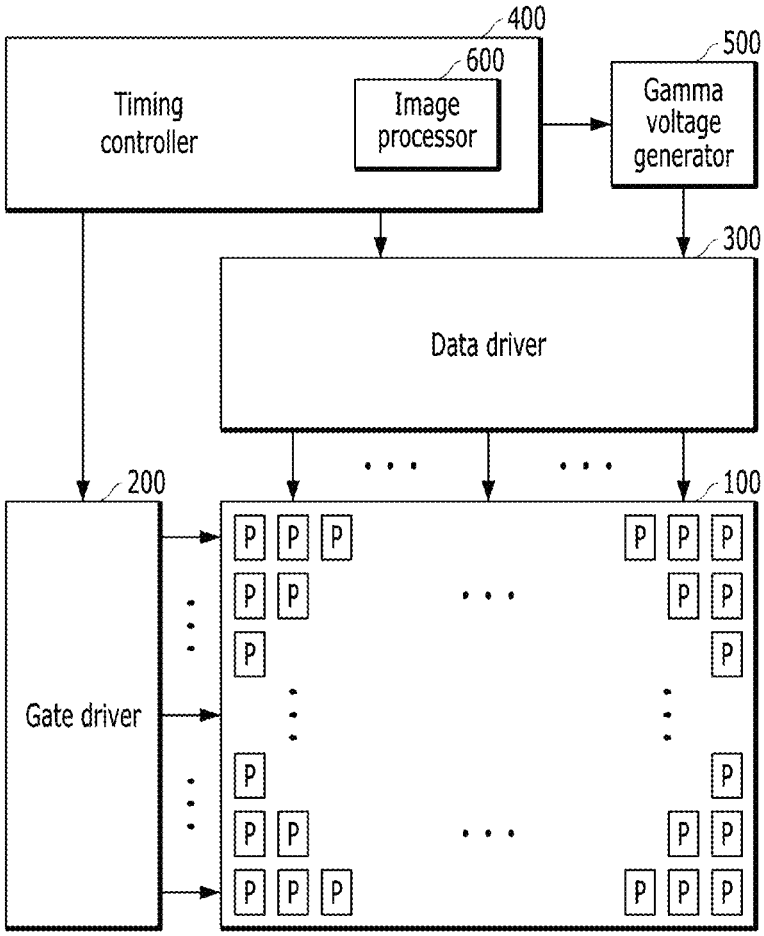
FIG. 1 is a block diagram schematically showing a configuration of a light emitting display device according to one or more embodiments of the present disclosure.
Figure 2:
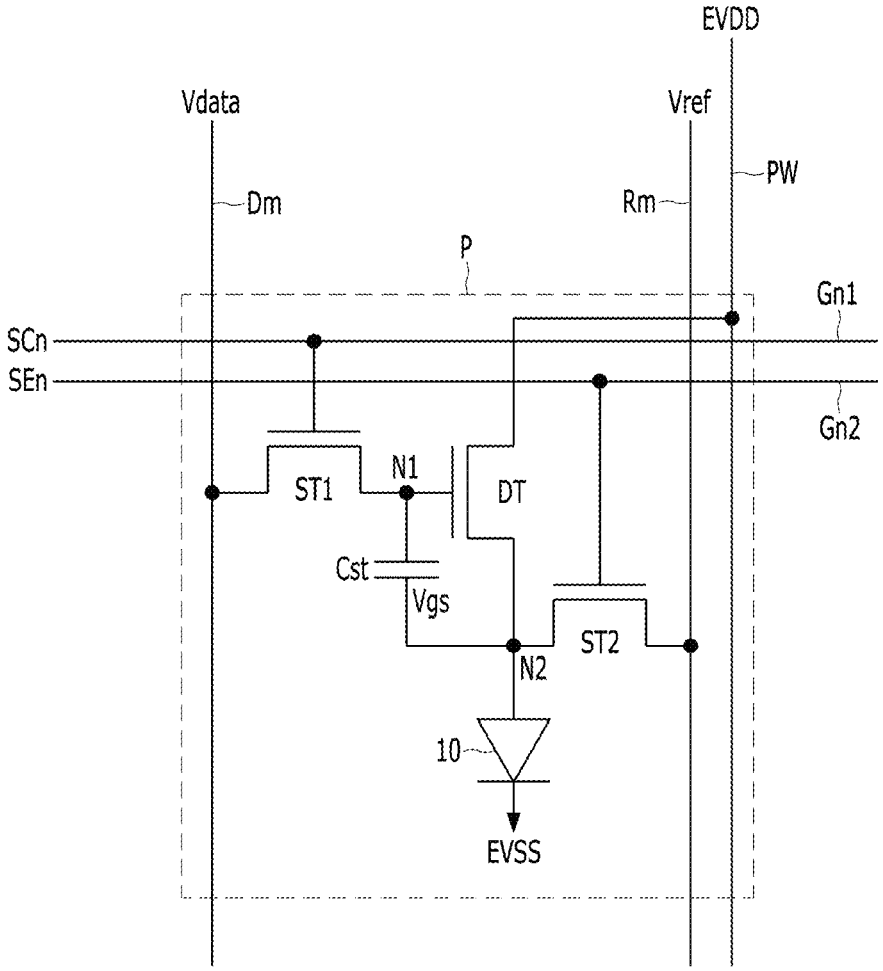
FIG. 2 is an equivalent circuit diagram of a subpixel shown in FIG. 1.

FIG. 1 is a block diagram showing a configuration of a light emitting display device according to one or more embodiments of the present disclosure and FIG. 2 is an equivalent circuit diagram showing a configuration of a subpixel shown in FIG. 1.

Referring to FIG. 1, the light emitting display device may include a panel 100, a gate driver 200, a data driver 300, a timing controller 400, and a gamma voltage generator 500.

The panel 100 displays an image through a pixel array. The pixel array may include red (R), green (G) and blue (B) subpixels P and further include white (W) subpixels. In some embodiments, the panel 100 may be a panel to which a touch sensor superposed on the pixel array is attached. In other embodiments, the panel 100 may be a panel in which a touch sensor superposed on the pixel array is included.

Each subpixel P includes a light emitting element and a pixel circuit for independently driving the light emitting element. The pixel circuit includes a plurality of TFTs including at least a driving TFT for driving the light emitting element and a switching TFT for supplying a data signal to the driving TFT, and a storage capacitor that stores a driving voltage Vgs corresponding to a data signal supplied through the switching TFT and provides the driving voltage Vgs to the driving TFT.

For example, each subpixel P includes a pixel circuit including at least a light emitting element 10 connected between a power line through which a high driving voltage (e.g., first driving voltage EVDD) is supplied and an electrode for supplying a low driving voltage (e.g., second driving voltage EVSS), first and second switching TFTs ST1 and ST2, a driving TFT DT, and a storage capacitor Cst for independently driving the light emitting element 10, as shown in FIG. 2. Various configurations in addition to the configuration of FIG. 2 may be applied to the pixel circuit.

An amorphous silicon (a-Si) TFT, a polysilicon TFT, an oxide TFT, an organic TFT, or the like may be used as the switching TFTs ST1 and ST2 and the driving TFT DT.

The light emitting element 10 includes an anode connected to a source node N2 of the driving TFT DT, a cathode connected to an EVSS supply line, and an organic emission layer interposed between the anode and the cathode. Although the anode is independently provided for each subpixel, the cathode may be a common electrode shared by subpixels. The light emitting element 10 generates light with brightness in proportion to a driving current value in such a manner that electrons from the cathode are injected into the organic emission layer and holes from the anode are injected to the organic emission layer when driving current is supplied from the driving TFT DT and thus the organic emission layer emits a fluorescent or phosphorescent light according to recombination of electrons and holes.

The first switching TFT ST1 is driven by a gate pulse signal SCn supplied from the gate driver 200 to a gate line Gn1 and provides a data voltage Vdata supplied from the data driver 300 to a data line Dm to a gate node N1 of the driving TFT DT.

The second switching TFT ST2 is driven by a gate pulse signal SEn supplied from the gate driver 200 to another gate line Gn2 and provides a reference voltage Vref supplied from the data driver 300 to a reference line Rm to the source node N2 of the driving TFT DT.

The storage capacitor Cst connected between the gate node N1 and the source node N2 of the driving TFT DT charges a difference voltage between the data voltage Vdata and the reference voltage Vref respectively supplied to the gate node N1 and the source node N2 through the first and second switching TFTs ST1 and ST2 as the driving voltage Vgs of the driving TFT DT and holds the charged driving voltage Vgs for an emission period in which the first and second switching TFTs ST1 and ST2 are turned off.

The driving TFT DT controls current supplied through the EVDD line PW according to the driving voltage Vgs supplied from the storage capacitor Cst to supply driving current determined by the driving voltage Vgs to the light emitting element 10 such that the light emitting element 10 emits light.

The gate driver 200 and the data driver 300 shown in FIG. 1 may be referred to as a panel driver for driving the panel 100.

The gate driver 200 performs a shifting operation upon reception of a plurality of gate control signals from the timing controller 300 to individually drive gate lines of the panel 100. The gate driver 200 supplies a gate ON voltage to a corresponding gate line for an operation period of each gate line and supplies a gate OFF voltage to a corresponding gate line for a non-operation period of each gate line. The gate driver 200 may be formed together with TFTs of the pixel array and included in the panel 100 in the form of a gate in panel (GIP). However, in other embodiments, panel types besides the gate in panel (GIP) may be utilized.

The gamma voltage generator 500 generates a plurality of reference gamma voltages having different levels and provides the reference gamma voltages to the data driver 300. The gamma voltage generator 500 may generate or control the plurality of reference gamma voltages corresponding to gamma characteristics of the display device under the control of the timing controller 400 and provide the same to the data driver 300.

The data driver 300 is controlled by a data control signal supplied from the timing controller 400, converts digital data supplied from the timing controller 400 into an analog data signal and provides the analog data signal to data lines of the panel 100. The data driver 300 converts the digital data into the analog data signal using grayscale voltages obtained by dividing the plurality of reference gamma voltages supplied from the gamma voltage generator 500. The data driver 300 can provide the reference voltage Vref to reference lines of the panel 100 under the control of the timing controller 400.

The data driver 300 can provide a sensing data voltage and the reference voltage to the data lines and the reference lines in a sensing mode under the control of the timing controller 400. In a subpixel P operating in the sensing mode, the driving TFT DT can operate by receiving the data voltage Vdata for sensing supplied through the data line Dm and the first switching TFT ST1 and the reference voltage Vref supplied through the reference line Rm and the second switching TFT ST2. Current in which electrical characteristics (e.g., threshold voltage Vth and mobility) of the driving TFT DT or deterioration characteristics of the light emitting element 10 are reflected may be charged as a voltage in a line capacitor of the reference line Rm through the second switching TFT ST2 or converted into a voltage through a current integrator connected to the reference line Rm. The data driver 300 can convert a voltage in which characteristics of each subpixel P are reflected into sensing data and output the sensing data to the timing controller 400.

The timing controller 400 receives a source image and timing control signals from a host system. The host system may be any of a computer, a TV system, a set-top box, and a portable terminal such as a tablet, a smart phone, or a cellular phone. The timing control signals may include a dot clock signal, a data enable signal, a vertical synchronization signal, a horizontal synchronization signal, etc.

The timing controller 400 generates a plurality of data control signals for controlling driving timing of the data driver 300, provides the data control signals to the data driver 300, generates a plurality of gate control signals for controlling driving timing of the gate driver 300 and provides the gate control signals to the gate driver 400 using the received timing control signals and timing setting information stored therein.

The timing controller 400 may include an image processor 600 which performs various forms of image processing on the source image. The image processor 600 may be separated from the timing controller 400 and connected to the input terminal of the timing controller 400. In this case, the output of the image processor 600 can be provided to the data driver 300 through the timing controller 400.

The image processor 600 can determine a low-grayscale area in which a low grayscale expression problem is generated according to a maximum luminance and reproduce a luminance of the low-grayscale area according to a combination of a threshold value and a minimum value (e.g., 0 grayscale) using a grayscale reproduction mask. In other words, the image processor 600 can reproduce a low-grayscale area less than a threshold value in which an expression problem is generated on the basis of the threshold value varying according to a maximum luminance using an average combination of a threshold value for achieving excellent uniformity and grayscale expression and the minimum value (e.g., 0 grayscale) according to distributed arrangement. A threshold value of each color may be a minimum value among grayscale values or luminance values of colors having excellent uniformity and grayscale expression. The threshold value of each color may correspond to a minimum current value for achieving excellent uniformity and grayscale expression of a light emitting element.

To this end, the image processor 600 can use different threshold values of respective colors in response to a maximum luminance that can be changed according to an environment and a user, convert image data less than the threshold value of each color into the threshold value of each color or the minimum value 0 using the grayscale reproduction mask, and output the converted image data.

Particularly, the image processor 600 can generate a grayscale reproduction mask of each color in consideration of the threshold value of each color which varies according to a maximum luminance, and the lifespan of each light emitting element according to the usage thereof. The image processor 600 can vary positions to which threshold values and the minimum value 0 are applied by accumulating the usage of each light emitting element and determining mask values of a grayscale reproduction mask using the order of the cumulative usages of light emitting elements and the threshold value of each color. As a result, the image processor 600 can reduce lifespan deviations between light emitting elements. The image processor 600 outputs image data equal to or greater than the threshold value without changing the same. The low grayscale reproduction processing method of the image processor 600 will be described in detail later.

The image processor 600 may further perform a plurality of image processing procedures including definition correction, deterioration correction, luminance correction for power consumption reduction, and the like prior to low grayscale reproduction processing.

The timing controller 400 may additionally correct output of the image processor 600 using compensation values for characteristic deviations of subpixels stored in a memory before providing the output of the image processor 600 to the data driver 300. In the sensing mode, the timing controller 400 can sense characteristics of the subpixels P of the panel 100 through the data driver 300 and update the compensation values of the subpixels stored in the memory using sensing results.

As described above, the display device including the image processor 600 according to one or more embodiments can improve color unevenness and enhance color accuracy and low grayscale expression by reducing luminance deviation in a low-grayscale area irrespective of maximum luminance change and improve image sticking by decreasing luminance deviation due to lifespan differences between light emitting elements.

Figure 3:
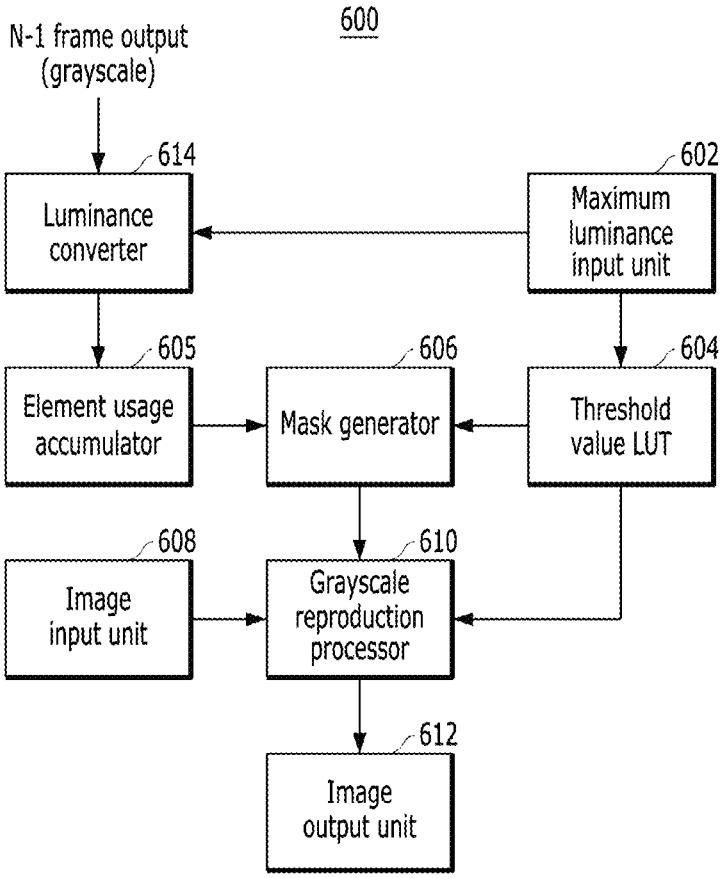
FIG. 3 is a block diagram schematically showing a configuration of an image processor according to one or more embodiments of the present disclosure.
Figure 4:
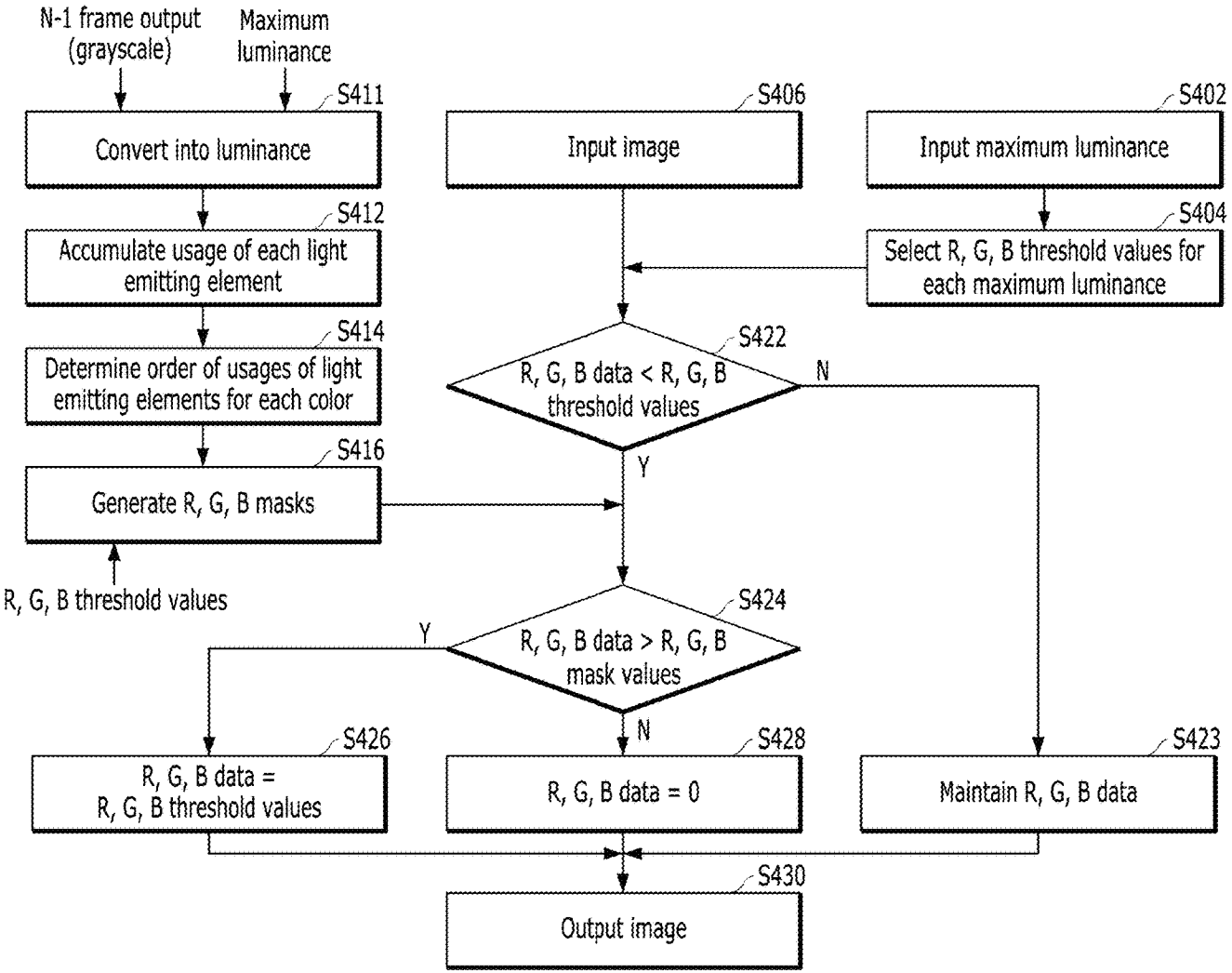
FIG. 4 is a flowchart showing an image processing method according to one or more embodiments of the present disclosure in stages.

FIG. 3 is a block diagram schematically showing a configuration of the image processor according to one or more embodiments of the present disclosure and FIG. 4 is a flowchart showing an image processing method according to one or more embodiments of the present disclosure. The image processing method shown in FIG. 4 is performed by the image processor 600 shown in FIG. 3.

Referring to FIG. 3, the image processor 600 according to an embodiment may include a maximum luminance input unit 602, a threshold value look-up table (LUT) 604, a mask generator 606, an image input unit 608, a grayscale reproduction processor 610, an image output unit 612, and a luminance converter 614. The units within the image processor 600 (such as the maximum luminance input unit 602, the image input unit 608, the image output unit 612) may include any electrical circuitry, features, components, an assembly of electronic components or the like configured to perform the various operations of the units as described herein. In some embodiments, the unit may be included in or otherwise implemented by processing circuitry such as a microprocessor, microcontroller, integrated circuit, chip, microchip or the like. The image processor may further include other components in addition to the components shown in FIG. 3.

Referring to FIGS. 3 and 4, the maximum luminance input unit 602 receives a maximum luminance from the outside and provides the maximum luminance to the threshold value LUT 604 and the luminance converter 614 (S402). The maximum luminance may be a maximum luminance set in the display device, a maximum luminance controlled according to luminance adjustment of a user, or a maximum luminance controlled in response to an external environment sensed through a sensor such as an illumination sensor.

The threshold value LUT 604 selects a threshold value of image data corresponding to the received maximum luminance and provides the threshold value to the mask generator 606 and the grayscale reproduction processor 610 (S404). Threshold values of data which correspond to a plurality of maximum luminances (a plurality of maximum luminance ranges) and are used to achieve excellent grayscale expression are preset for respective colors and stored in the threshold value LUT 604 in the form of an LUT. R, G and B threshold values may be minimum grayscale values (luminance values) among grayscale values (luminance values) that achieve excellent uniformity and grayscale expression in the respective colors. FIGS. 3 and 4 illustrate a case in which the R, G and B threshold values are grayscale values. Since R, G and B have different gamma forms, different threshold values for excellent grayscale expression can be set for the respective colors and the R, G and B threshold values can be differently set according to change in the maximum luminance. In other words, threshold values of R, G and B data for excellent grayscale expression may be differently set for maximum luminances and colors. For example, the threshold value of each color may decrease as a maximum luminance increases.

The image input unit 608 receives an input image from the outside and outputs the input image to the grayscale reproduction processor 610 (S406).

The luminance converter 614 converts grayscale data that is the output of a previous frame N−1 received from the grayscale reproduction processor 610 into luminance data and outputs the luminance data (S411). The luminance converter 614 converts R, G and B grayscale data that are nonlinear color values into linear color values through digamma operation processing and applying a maximum luminance thereto to convert the same into R, G and B luminance data.

An element usage accumulator 605 accumulates the R, G and B luminance data of the previous frame N−1 received from the luminance converter 614 in a light emitting element usage database (DB) (S412).

The mask generator 606 reads the usages of light emitting elements of a plurality of subpixels corresponding to the grayscale reproduction mask of each color from the element usage accumulator 605 and determines the order of the usages of the light emitting elements (S414). The mask generator 606 determines a mask value for each subpixel in consideration of the order of the usages of the light emitting elements, threshold values of colors and a mask size and generates a grayscale reproduction mask of each color using the mask value of each subpixel (S416). Here, the mask generator 606 may additionally apply a gamma constant when the mask value for each subpixel is determined.

The grayscale reproduction processor 610 receives R, G and B data from the image input unit 608, receives R, G and B threshold values from the threshold value LUT 604 and receives R, G and B reproduction masks from the mask generator 606. The grayscale reproduction processor 610 determines whether each piece of color data is low-grayscale data less than each color threshold value by comparing the R, G and B data with the R, G and B threshold values (S422).

If each piece of color data is equal to or greater than each color threshold value (N), the grayscale reproduction processor 610 outputs each piece of color data without converting the same (S423).

If each piece of color data is low-grayscale data less than each color threshold value (Y), the grayscale reproduction processor 610 compares corresponding color data with a mask value of a corresponding subpixel included in the grayscale reproduction mask of the corresponding color (S424). If each piece of color data is greater than the mask value of each subpixel (Y), the grayscale reproduction processor 610 converts the corresponding color data into the threshold value of the corresponding color and outputs the threshold value (S426). If each piece of color data is equal to or less than the mask value of each subpixel (N), the grayscale reproduction processor 610 converts the corresponding color data into the minimum value (0 grayscale) and outputs the minimum value (S428). Accordingly, the grayscale reproduction processor 610 reproduces low-grayscale (low-luminance) data less than each color threshold value according to a combination of the corresponding color threshold value and the minimum value 0.

The output unit 612 collects output data of the grayscale reproduction processor 610 and provides an output image (S430).

Figure 5:
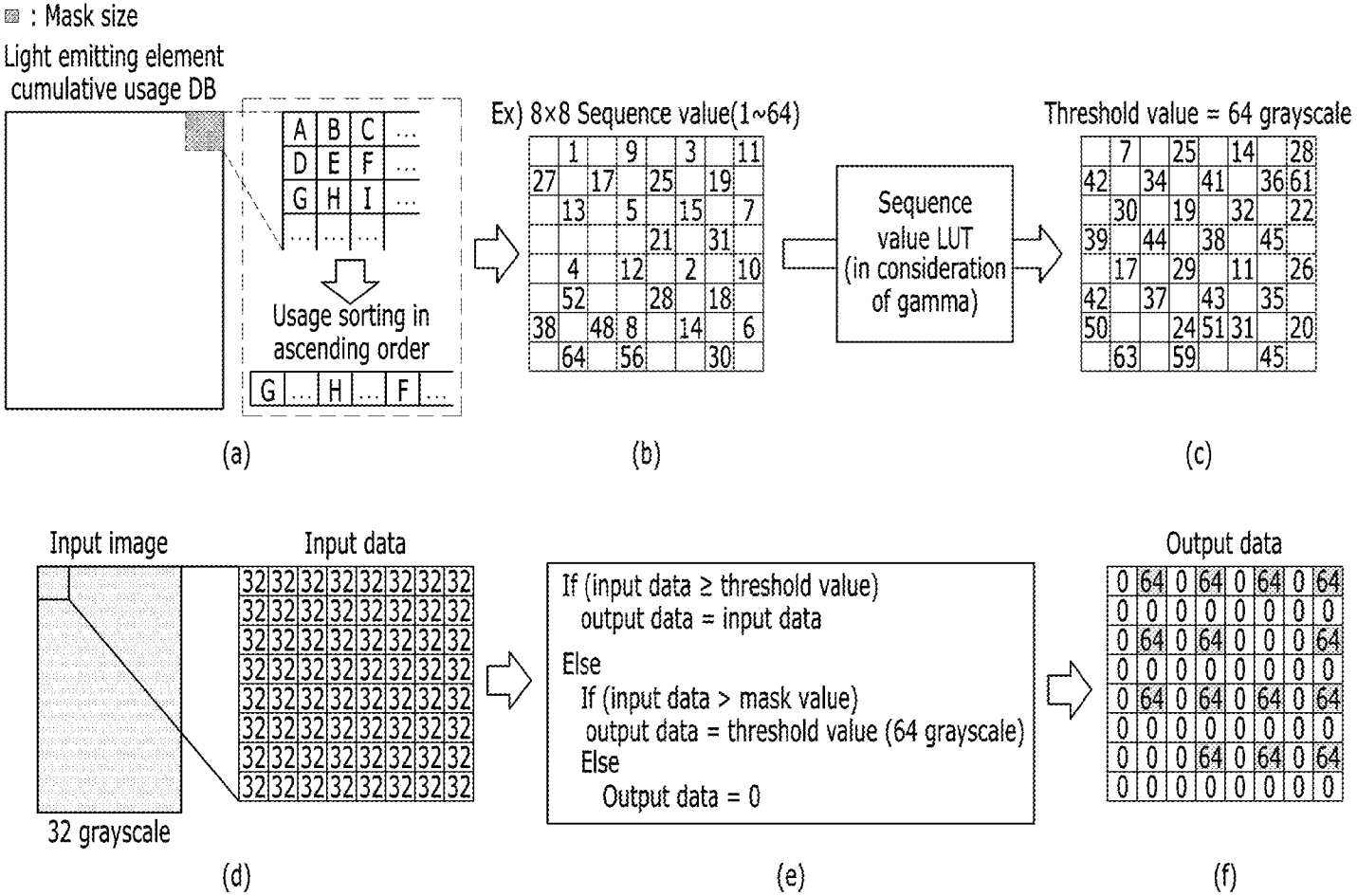
FIG. 5 is diagrams illustrating a mask generation method and a grayscale reproduction method according to one or more embodiments of the present disclosure.

FIG. 5 is diagrams illustrating a mask generation method and a grayscale reproduction method according to one or more embodiments of the present disclosure. FIGS. 5(*a*) to 5(*c*) show the mask generation method performed by the mask generator 606 of FIG. 3 and FIGS. 5(*d*) to 5(*f*) show the low grayscale reproduction method performed by the grayscale reproduction processor 610 of FIG. 3.

As shown in FIG. 5(*a*), the mask generator 606 reads the usages of light emitting elements with respect to a plurality of subpixels (e.g., 8*8) belonging to a grayscale reproduction mask from the element usage accumulator 605 and sorts the usages of the light emitting elements in ascending order. The mask generator 606 sorts the usages of light emitting elements belonging to the grayscale reproduction mask for each color.

As shown in FIG. 5(*b*), the mask generator 606 may assign sequence values 1 to 64 to a plurality of cells constituting the grayscale reproduction mask of each color on the basis of the usages of light emitting elements and process the assigned sequence values 1 to 64 using a sequence value LUT in consideration of a gamma constant.

As shown in FIG. 5(*c*), the mask generator 606 determines a mask value of each cell in consideration of the processed sequence value of each cell, the threshold value of each color, and a grayscale reproduction mask size (8*8) and generates a grayscale reproduction mask composed of 8*8 mask values for each color.

As shown in FIG. 5(*d*), the grayscale reproduction processor 610 extracts a plurality of (8*8) pieces of input data corresponding to the grayscale reproduction mask of each color from the input image for each color.

As shown in FIG. 5(*e*), the grayscale reproduction processor 610 compares the input data with the threshold value of each color and mask values of the grayscale reproduction mask of each color to perform grayscale reproduction. The grayscale reproduction processor 610 outputs the input data without converting the same if the input data is equal to or greater than the threshold value of each color. If the input data is less than the threshold value of each color and greater than each mask value of the grayscale reproduction mask of each color, the grayscale reproduction processor 610 converts the input data into the threshold value of each color and outputs the same. If the input data is less than the threshold value of each color and equal to or less than each mask value of the grayscale reproduction mask of each color, the grayscale reproduction processor 610 converts the input data into the minimum value 0 and outputs the same.

As a result, the grayscale reproduction processor 610 can reproduce 64 32-grayscale input data corresponding to the grayscale reproduction mask size according to a combination of 14 64-grayscale (G threshold value) output data and 50 0-grayscale output data, as shown in FIG. 5(*f*).

Figure 6:
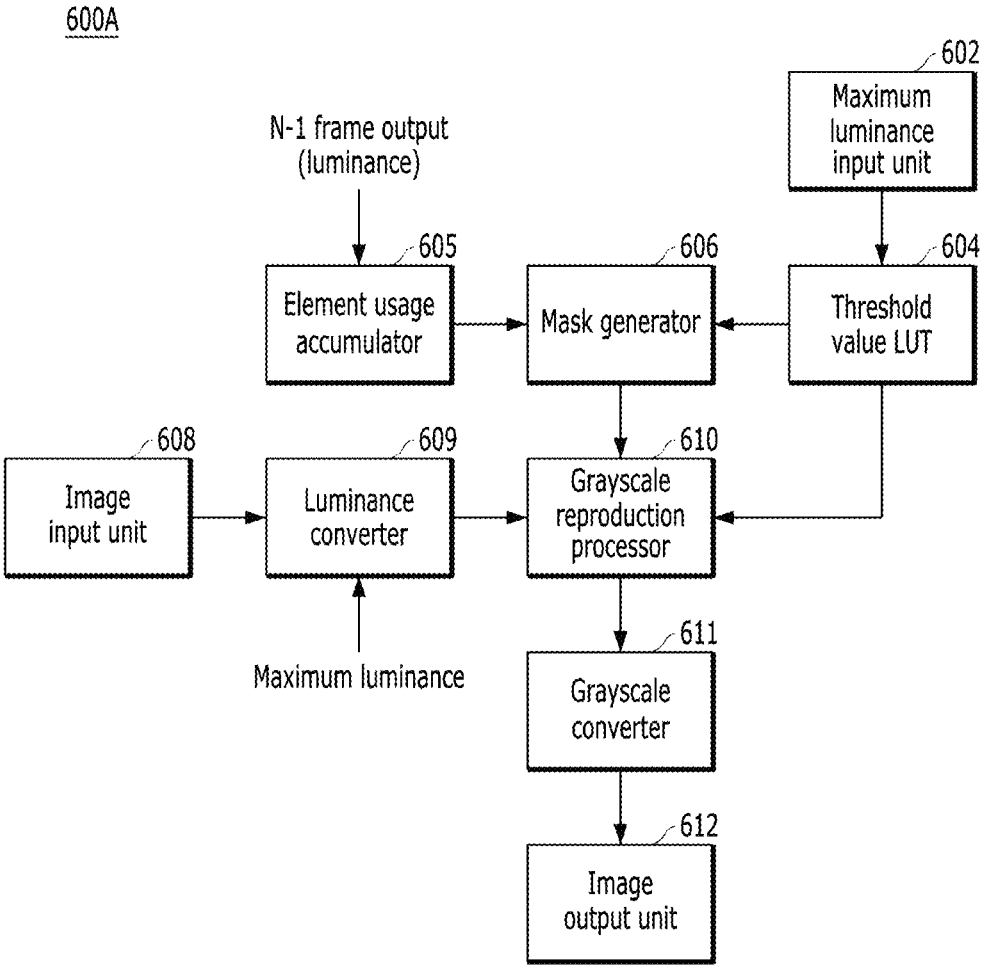
FIG. 6 is a block diagram schematically showing a configuration of an image processor according to one or more embodiments of the present disclosure.
Figure 7:
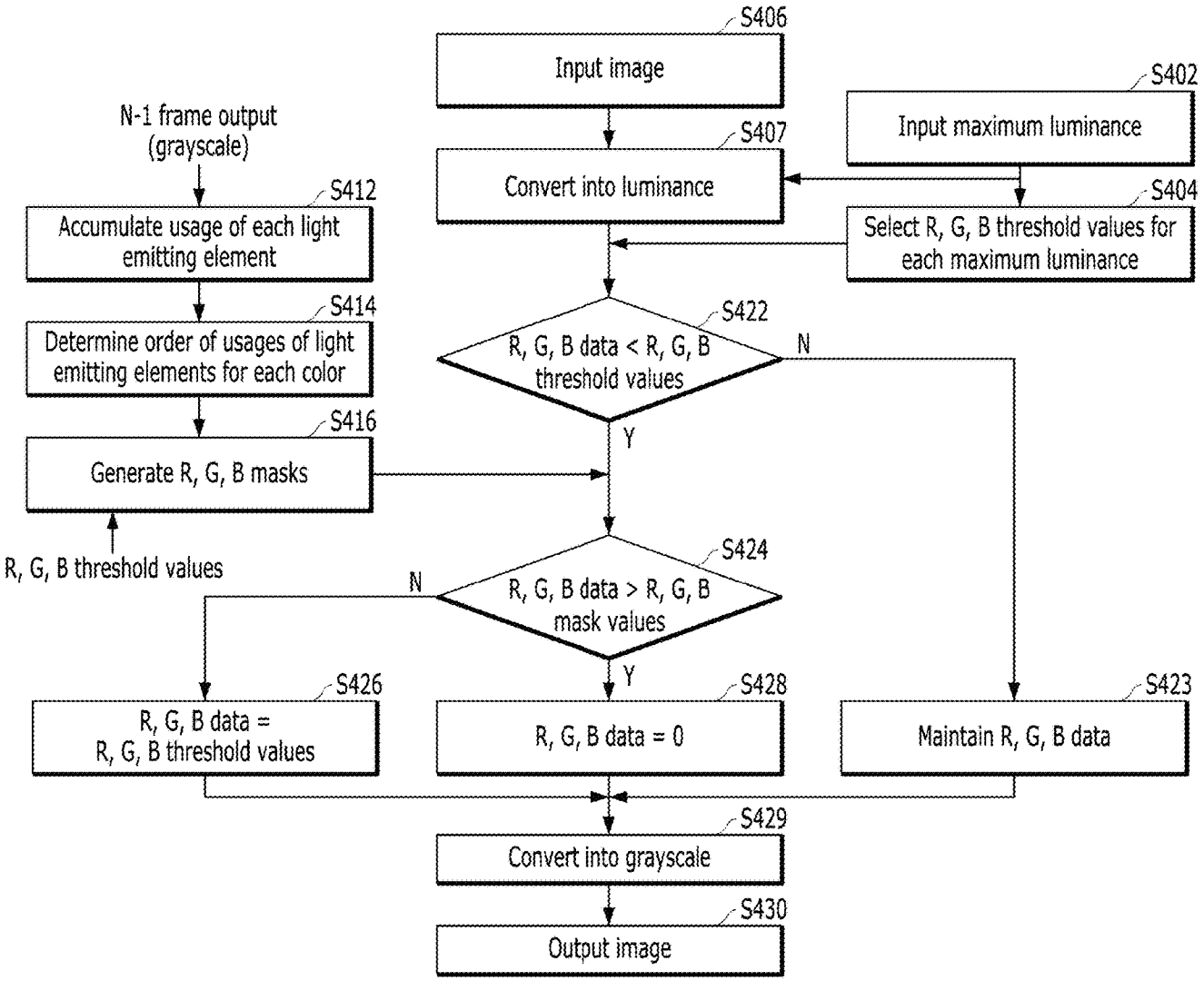
FIG. 7 is a flowchart showing an image processing method according to one or more embodiments of the present disclosure in stages.

FIG. 6 is a block diagram schematically showing a configuration of an image processor according to one or more embodiments of the present disclosure and FIG. 7 is a flowchart showing an image processing method according to one or more embodiments of the present disclosure in stages.

The image processor 600 shown in FIG. 3 and the image processing method shown in FIG. 4 perform low grayscale reproduction on the basis of grayscale data, whereas the image processor 600A shown in FIG. 6 and the image processing method shown in FIG. 7 perform low grayscale reproduction on the basis of luminance data, and description of redundant components is omitted.

The image processor 600A shown in FIG. 6 differs from the image processor 600 shown in FIG. 3 in that a luminance converter 609 which converts grayscale data of each color into luminance data of each color is inserted between the input image unit 608 and the grayscale reproduction processor 610. A grayscale converter 611 which converts luminance data of each color into grayscale data of each color is inserted between the grayscale reproduction processor 610 and the image output unit 612. The luminance converter 614 connected to the element usage amount accumulator 605 in FIG. 3 is removed in the embodiment shown in FIG. 6. The element usage amount accumulator 605 can receive R, G and B luminance data output from the grayscale reproduction processor 610 as output of a previous frame and accumulate the same as the usage of each light emitting element. The R, G and B threshold values stored in the threshold value LUT 604 are minimum values among luminance values for excellent uniformity and grayscale expression in the respective colors.

The image processing method shown in FIG. 7 differs from the image processing method shown in FIG. 4 in that a luminance conversion step S407 of the luminance converter 609 is additionally included between the image input step S406 of the image input unit 608 and the step S422 of comparing R, G and B data with threshold values performed by the grayscale reproduction processor 610. A grayscale conversion step S429 of the grayscale converter 611 is additionally included between the output steps S426, S428 and S423 of the grayscale reproduction processor 610 and the image output step S430 of the image output unit 612. The luminance conversion step S411 prior to the light emitting element usage amount accumulation step S412 in FIG. 4 is removed.

Figure 8:
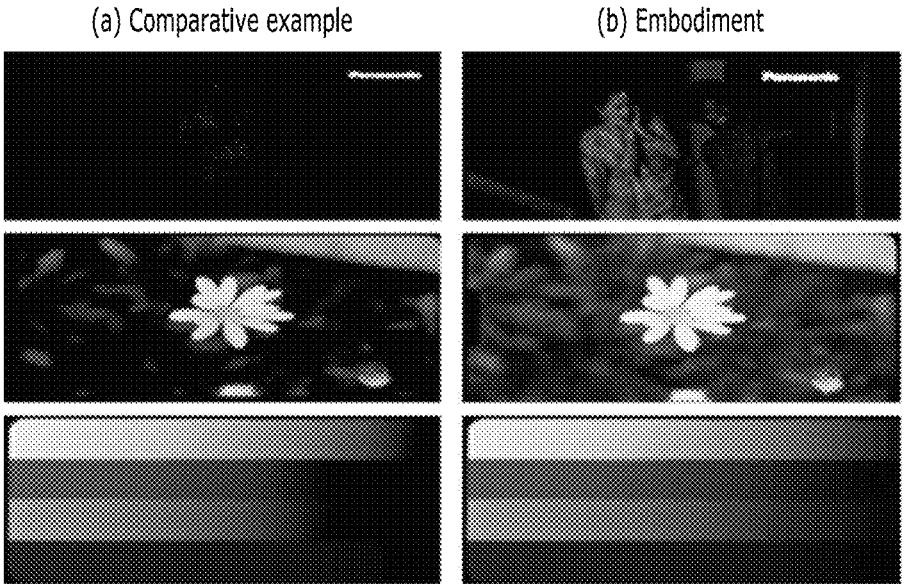
FIG. 8 is diagrams showing images displayed through the light emitting display device according to one or more embodiments of the present disclosure in comparison with comparative examples.
Figure 9:
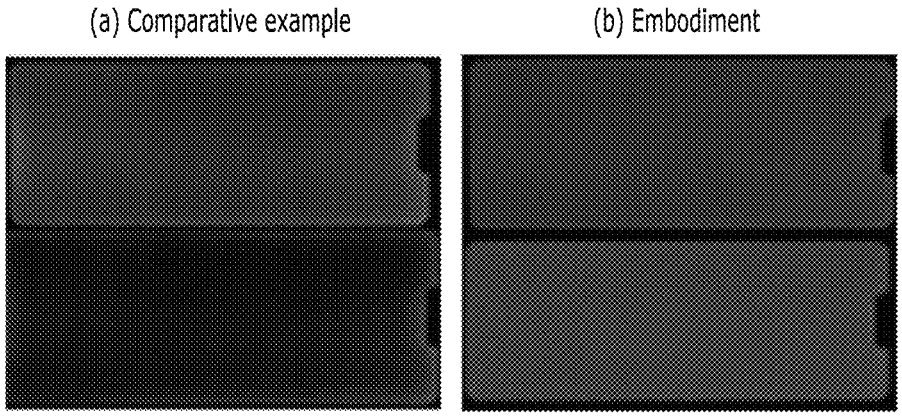
FIG. 9 is diagrams showing results of low grayscale display of the light emitting display device according to one or more embodiments of the present disclosure in comparison with comparative examples.

FIG. 8 is diagrams showing images displayed through the light emitting display device according to one or more embodiments of the present disclosure in comparison with comparative examples and FIG. 9 is diagrams showing results of low grayscale display of the light emitting display device according to an embodiment of the present disclosure in comparison with comparative examples.

Although images displayed through a light emitting display device of a comparative example shown in FIG. 8(*a*) have problems in definition due to low low-grayscale expression, it can be ascertained that images displayed through the light emitting display device of an embodiment of the present disclosure shown in FIG. 8(*b*) have improved low-grayscale expression and definition. Although there are problems in low-grayscale expression of green and red to which lower current than that of blue is supplied in the comparative example of FIG. 8(*a*), it can be ascertained that low-grayscale expression is improved in all colors in the embodiment shown in FIG. 8(*b*).

Although monochromatic low-grayscale images displayed through a light emitting display device of a comparative example shown in FIG. 9(*a*) have a color unevenness problem due to non-uniform luminance, it can be ascertained that monochromatic low-grayscale images displayed through the light emitting display device of an embodiment shown in FIG. 9(*b*) have enhanced uniformity and improved color unevenness.

Figure 10:
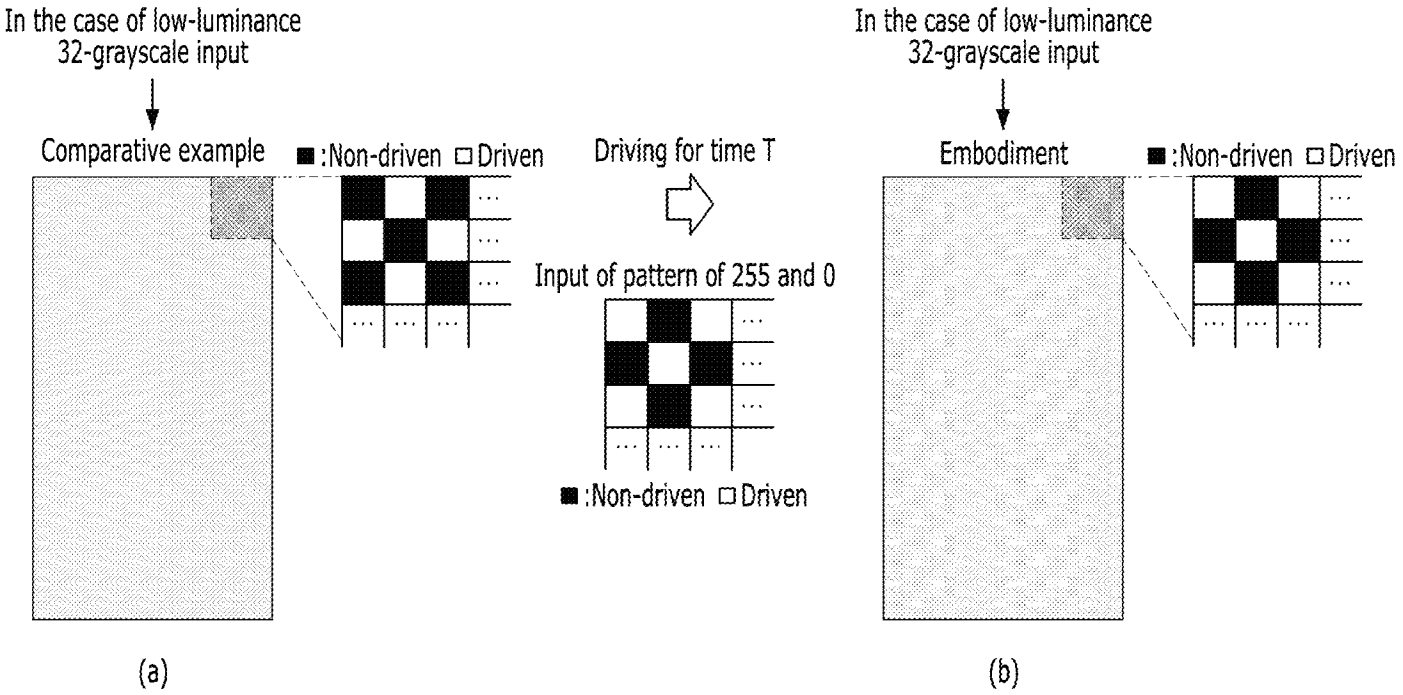
FIG. 10 is diagrams showing a method for checking whether the light emitting display device according to one or more embodiments is applicable to image processing.

FIG. 10 is diagrams showing a method for checking whether the light emitting display device according to one or more embodiments is applicable to image processing.

In a comparative example shown in FIG. 10(*a*), although a 32-grayscale input image can be represented according to a combination of non-driven subpixels and driven subpixels, positions of non-driven subpixels representing grayscale 0 and positions of driven subpixels representing threshold values of colors may be fixed, as shown in FIG. 10(*a*), when a dot pattern image in which grayscale 255 and grayscale 0 alternate is displayed for a long time T and then the 32-grayscale input image is re-displayed.

On the other hand, in an embodiment shown in FIG. 10(*b*), although a 32-grayscale input image is represented according to a combination of non-driven subpixels and driven subpixels at the time of initial driving, as shown in FIG. 10(*a*), positions of non-driven subpixels representing grayscale 0 and positions of driven subpixels representing threshold values of colors are changed according to the usage of each subpixel when a dot pattern image in which 255 grayscale and 0 grayscale alternate is displayed for a long time T and then the 32-grayscale input image is re-displayed.

Accordingly, it is possible to check whether the present disclosure is applicable to image processing by confirming that the positions of non-driven subpixels and the positions of driven subpixels are changed according to the usage of each subpixel even when the same low-grayscale input image is displayed.

As described above, according to an embodiment, it is possible to reduce luminance deviation in a low-grayscale area to improve color unevenness and enhance color accuracy and low-grayscale expression by generating and applying a grayscale reproduction mask considering a maximum luminance of a light emitting display device and the lifespan of each light emitting element to reproduce low grayscale as a combination of threshold values for achieving excellent uniformity and grayscale expression and a minimum value.

According to an embodiment, it is possible to improve color unevenness and enhance color accuracy and low-grayscale expression in a low-grayscale area irrespective of luminance change by generating and applying a grayscale reproduction mask using a threshold value of each color which varies according to change of a maximum luminance of a display device.

According to an embodiment, it is possible to reduce lifespan deviations between light emitting elements by varying each mask value of a grayscale reproduction mask on the basis of the usage of each light emitting element to vary positions to which threshold values and a minimum value are applied and to improve image sticking by decreasing luminance deviation due to lifespan deviations between light emitting elements.

It will be apparent to those skilled in the art that various modifications and variations can be made in the present disclosure without departing from the spirit or scope of the disclosure.

The various embodiments described above can be combined to provide further embodiments. Other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A light emitting display device, comprising:

an image processor for converting image data that is less than a threshold value into any one of either the threshold value and a minimum value using a grayscale reproduction mask that is based on the threshold value, outputting the converted image data, and outputting image data equal to or greater than the threshold value without changing the image data;

a panel operatively coupled to the image processor, the panel including a plurality of subpixels having light emitting elements; and a panel driver operatively coupled to the image processor and the panel, the panel driver providing the output of the image processor to the panel, wherein, in a low-grayscale area less than the threshold value, positions of driven subpixels representing the threshold value and positions of driven subpixels representing the minimum value are varied over time when driving the panel.

2. The light emitting display device of claim 1, wherein the threshold value is selected based on an input maximum luminance value.

3. A light emitting display device, comprising:

an image processor for converting image data that is less than a threshold value into any one of either the threshold value and a minimum value using a grayscale reproduction mask that is based on the threshold value, outputting the converted image data, and outputting image data equal to or greater than the threshold value without changing the image data;

a panel operatively coupled to the image processor, the panel including a plurality of subpixels having light emitting elements; and a panel driver operatively coupled to the image processor and the panel, the panel driver providing the output of the image processor to the panel, wherein positions of subpixels representing the threshold value and positions of subpixels representing the minimum value are varied according to a cumulative usage of each light emitting element and the threshold value.

4. A light emitting display device, comprising:

an image processor for converting image data that is less than a threshold value into any one of either the threshold value and a minimum value using a grayscale reproduction mask that is based on the threshold value, outputting the converted image data, and outputting image data equal to or greater than the threshold value without changing the image data;

a panel operatively coupled to the image processor, the panel including a plurality of subpixels having light emitting elements; and a panel driver operatively coupled to the image processor and the panel, the panel driver providing the output of the image processor to the panel, wherein the image processor comprises:

a threshold value look up table (LUT) for selecting a threshold value of each color corresponding to the input maximum luminance from a plurality of different threshold values set for colors and outputting selected threshold values for a plurality of maximum luminances;

an element usage accumulator for accumulating output of a previous frame as a usage of each light emitting element;

a mask generator for generating and outputting the grayscale reproduction mask of each color in consideration of the threshold value of each color output from the threshold value LUT and a cumulative usage of each light emitting element stored in the element usage accumulator; and a grayscale reproduction processor for comparing input image data with the threshold value of each color, comparing image data less than the threshold value of each color with each mask value determined in the grayscale reproduction mask of each color, converting the image data into the threshold value of each color or the minimum value, outputting the converted image data, and outputting image data equal to or greater than the threshold value of each color without converting the image data.

5. The light emitting display device of claim 4, wherein the mask generator determines each mask value corresponding to each subpixel and generates the grayscale reproduction mask of each color in consideration of sequence values assigned to subpixels corresponding to the grayscale reproduction mask of each color in response to the cumulative usage of each light emitting element, a gamma constant, the threshold value of each color, and the size of the grayscale reproduction mask.

6. The light emitting display device of claim 5, wherein the mask generator reads the usages of light emitting elements with respect to a plurality of subpixels belonging to the grayscale reproduction mask and sorts the usages of the light emitting elements in ascending order, assigns sequence values to a plurality of cells constituting the grayscale reproduction mask of each color on the basis of the usages of the light emitting elements and processes the assigned sequence values using a sequence value LUT in consideration of a gamma constant, and determines a mask value of each cell in consideration of the processed sequence value of each cell, the threshold value of each color, and a grayscale reproduction mask size and generates a grayscale reproduction mask composed of mask values for each color.

7. The light emitting display device of claim 5, wherein the grayscale reproduction processor converts image data less than the threshold value of each color into the threshold value of each color and outputs the converted image data if the image data is greater than a corresponding mask value of the grayscale reproduction mask of each color, and converts image data less than the threshold value of each color into the minimum value and outputs the converted image data if the image data is equal to or less than a corresponding mask value of the grayscale reproduction mask of each color.

8. The light emitting display device of claim 7, wherein the image processor further comprises:

a maximum luminance input unit for receiving the maximum luminance from an outside and providing the maximum luminance to the threshold value LUT and the luminance converter.

9. The light emitting display device of claim 8, wherein the maximum luminance is a maximum luminance set in the light emitting display device, a maximum luminance controlled according to luminance adjustment of a user, or a maximum luminance controlled in response to an external environment sensed through an illumination sensor.

10. The light emitting display device of claim 4, wherein the image processor further comprises a luminance converter for converting the output of the previous frame into a luminance value and outputting the luminance value to the element usage accumulator when the threshold value of each color is a grayscale value.

11. The light emitting display device of claim 4, wherein the image processor further comprises:

a luminance converter positioned at an input terminal of the grayscale reproduction processor to convert a grayscale value which is the input image data into a luminance value and output the luminance value to the grayscale reproduction processor when the threshold value of each color is a luminance value; and a grayscale converter for converting a luminance value output from the grayscale reproduction processor into a grayscale value and outputting the grayscale value, wherein the element usage accumulator receives and accumulates the output of the grayscale reproduction processor as output of the previous frame.

12. A method for driving a light emitting display device, comprising:

selecting a threshold value of each color based on an input maximum luminance from a plurality of different threshold values set for colors;

outputting selected threshold values for a plurality of maximum luminances;

accumulating output of a previous frame as a usage of each light emitting element for each of a plurality of subpixels;

generating a grayscale reproduction mask of each color in consideration of the selected threshold value of each color and a cumulative usage of each light emitting element;

comparing input image data with the threshold value of each color;

comparing image data less than the threshold value of each color with a corresponding mask value in the grayscale reproduction mask of each color;

converting the image data into the threshold value of each color or a minimum value;

outputting the converted image data;

outputting image data equal to or greater than the threshold value of each color without converting the image data; and displaying the outputted image data on a panel.

13. The method of claim 12, wherein generating the grayscale reproduction mask includes:

determining a mask value corresponding to each subpixel; and generating the grayscale reproduction mask of each color in consideration of sequence values assigned to subpixels corresponding to the grayscale reproduction mask of each color in response to the cumulative usage of each light emitting element, a gamma constant, the threshold value of each color, and the size of the grayscale reproduction mask.

14. The method of claim 13, wherein generating the grayscale reproduction mask includes:

reading the usages of light emitting elements with respect to a plurality of subpixels belonging to a grayscale reproduction mask and sorting the usages of the light emitting elements in ascending order;

assigning sequence values to a plurality of cells constituting the grayscale reproduction mask of each color on the basis of the usages of light emitting elements and processing the assigned sequence values using a sequence value LUT in consideration of a gamma constant; and determining a mask value of each cell in consideration of the processed sequence value of each cell, the threshold value of each color, and a grayscale reproduction mask size and generating a grayscale reproduction mask composed of mask values for each color.

15. The method of claim 13, wherein converting the image data into the threshold value of each color or a minimum value includes:

converting image data less than the threshold value of each color into the threshold value of each color;

outputting the converted image data if the image data is greater than a corresponding mask value of the grayscale reproduction mask of each color;

converting image data less than the threshold value of each color into the minimum value; and outputting the converted image data if the image data is equal to or less than a corresponding mask value of the grayscale reproduction mask of each color.

16. The method of claim 12, wherein positions of subpixels representing the threshold value and positions of subpixels representing the minimum value are varied with a lapse of driving time of the panel even in the case of the same image data less than the threshold value.

17. The method of claim 12, further comprising:

converting the output of the previous frame into a luminance value; and outputting the luminance value when the threshold value of each color is a grayscale value.

18. The method of claim 12, further comprising:

converting a grayscale value which is the input image data into a luminance value when the threshold value is a luminance value prior to comparing input image data with the threshold value of each color; and converting a luminance value output into a grayscale value; and outputting the grayscale value.

19. The method of claim 12, wherein the grayscale reproduction mask of each color is applied to a low-grayscale area less than the threshold value of each color to reproduce a luminance of the low-grayscale area as a combination of the threshold value of each color and the minimum value.

20. The method of claim 12, wherein the maximum luminance is a maximum luminance set in the light emitting display device, a maximum luminance controlled according to luminance adjustment of a user, or a maximum luminance controlled in response to an external environment sensed through an illumination sensor.

* * * * *